United States Patent [19]

Schiel et al.

[11] 4,214,949

[45] Jul. 29, 1980

[54] SUPPORTING DEVICE FOR A STRAINER BELT

[75] Inventors: Christian Schiel; Hans Flamig, both of Heidenheim, Fed. Rep. of Germany

[73] Assignee: J. M. Voith GmbH, Heidenheim, Fed. Rep. of Germany

[21] Appl. No.: 969,815

[22] Filed: Dec. 15, 1978

[30] Foreign Application Priority Data

Dec. 21, 1977 [DE] Fed. Rep. of Germany ..... 2756994

[51] Int. Cl.[2] ..... D21F 1/54

[52] U.S. Cl. ..... 162/352; 162/374

[58] Field of Search ..... 162/352, 374

[56] References Cited

U.S. PATENT DOCUMENTS 2,893,486 7/1959 Marti ..... 162/352

4,067,770 1/1978 Blott et al. ..... 162/374 X

FOREIGN PATENT DOCUMENTS 1958758 6/1971 Fed. Rep. of Germany ..... 162/352

*Primary Examiner*—Richard V. Fisher

*Attorney, Agent, or Firm*—Albert L. Jeffers; John F. Hoffman

[57] ABSTRACT

A supporting device for a strainer belt in a paper making apparatus of the type including a plurality of wear strips which, in use, are disposed transversely to the strainer belt, each of the strips having a wear surface on which the belt is supported as it passes over them. Each of the wear strips is adapted to be clamped on a supporting element between a leaf spring and a retaining plate, which are secured to the supporting element, said strip having a bearing surface which rests on the bearing surface of the support element. The wear strip has a symmetrical shape so that the wear surface and bearing surface may be disposed interchangeably either to face the strainer belt or to face the bearing surface of the support element.

13 Claims, 2 Drawing Figures

SUPPORTING DEVICE FOR A STRAINER BELT

The present invention relates to a supporting device for a strainer belt in a paper making machine, of the type which includes at least one wear strip which, in use, is disposed transverse to the strainer belt and which has a wear surface intended to face the strainer belt. The wear strip is adapted to be clamped on a support element by a spring clip and supported on a bearing surface of the support element extending in the longitudinal direction of the wear strip. The present invention is an improvement of the supporting device of this general type, which is described in West German Patent Specification No. 1,958,758, in such a way that it is less expensive to produce and more economical in use.

The supporting device of the present invention is characterized in that the surface of the wear strip adapted to be supported by the bearing surface of the support element is also formed as a wear surface, so that the wear strip has a symmetrical shape enabling the wear and bearing surfaces thereof to be disposed interchangeably either to face and support the strainer belt or to face the bearing surface on the bearing element. Accordjing to a special feature of the invention, provision is made for the wear strip to have a crosssection in the shape of a parallelogram, with the wear and bearing surfaces thereof being formed on opposite sides. The front face of the wear strip which, in use, faces opposite to the direction in which the strainer belt moves, and which extends at an acute angle to the wear surface, defines a recess which extends in a longitudinal direction of the strip and which accommodates one end of a leaf spring attached to the support element. This spring presses the wear strip bearing surface against the support element bearing surface and simultaneously presses the rear face of the strip against an angled retaining surface of the support element. The part of the support element which forms the retaining surface may be a plate, one end of which is attached to the support element and the opposite end of which is bent forwardly in the direction opposite to the direction of movement of the strainer belt. The part of the support element which forms the retaining surface may comprise a spring member.

The wear surface of the strip may be less than 10 mm. wide in the direction of movement of the strainer belt, and preferably has a width of between 4 mm. and 8 mm. The wear strip may be less than 20 mm. high, preferably between 6 mm. and 15 mm., in a direction perpendicular to the direction of movement of the strainer belt. It is preferable that the wear strip be made almost entirely of a material which is very hard and/or has a low friction coefficient relative to the strainer belt, such as a ceramic material.

In one application of the invention, a plurality of such wear strips are arranged one behind the other on a water extraction box, such as a suction box. The construction of such an apparatus is simplified if the cross bars of the water extraction box are used directly as the support elements for the wear strips. In the case of prior art wear strips, an additional attaching strip between each of them and their respective cross bar is required. With a supporting device according to the present invention, however, this is no longer required because the wear strips can be attached directly to the cross bars.

The supporting device of the invention has the particular advantage that only two surfaces of the wear element need to be accurately machined because these two surfaces may be used interchangeably either as a wear surface or as a bearing surface. This results in significant savings and production costs, since known wear strips require more than two accurately machined surfaces. Since the wear elements are normally made from a very hard material, grinding of them to produce the accurately machined surfaces is quite expensive and time consuming.

The present invention enables the use of relatively short wear strips with very small cross-sections and very narrow wear surfaces. This provides a greater open area between the individual wear strips of up to 80% with minimum strip-spacing in a water extraction box, thereby resulting in good water extraction through the strainer belt passing over the wear strips. Such a large open area between the individual wear strips is not possible with known prior art devices because they result in much wider wear surfaces, especially if the strips are made of ceramic material.

BRIEF DESCRIPTION OF THE DRAWINGS

One embodiment of a supporting device according to the present invention is shown in the accompanying drawing in which.

DETAILED DESCRIPTION

Figure 2:
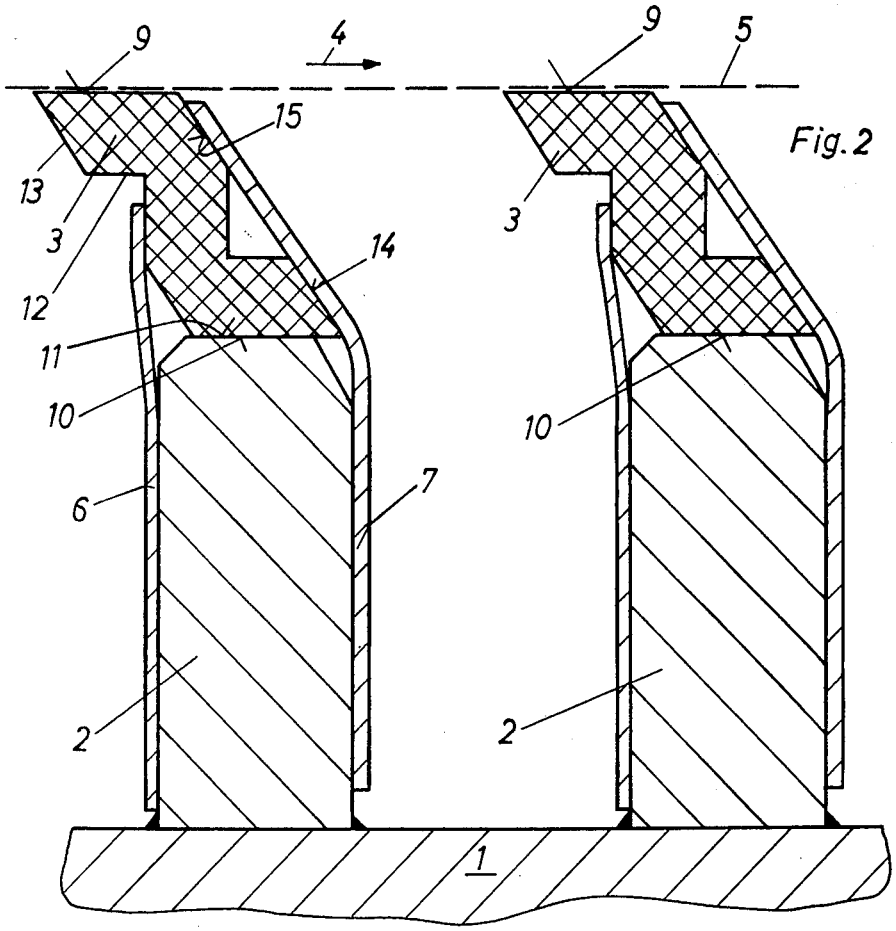
FIG. 2 is a sectional view taken along line 2—2 of FIG. 1 and viewed in the direction of the arrows.
Figure 1:
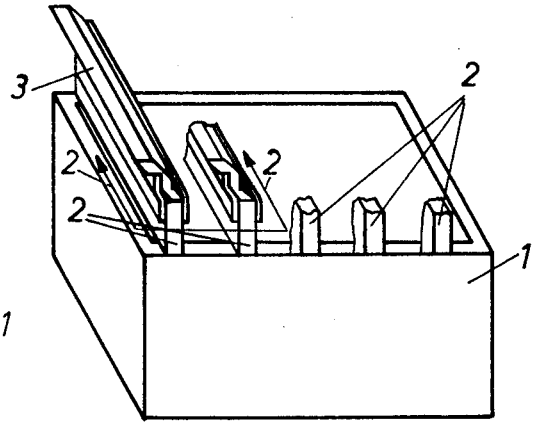
FIg. 1 is a fragmentary schematic perspective view of the supporting device according to the present invention being used on a conventional water extraction box.

Referring now to the drawings in detail, open water extraction box 1 comprises a plurality of cross bars which also serve as support elements 2 for each wear strip 3. A strainer belt 5 passes over these in the direction of movement indicated by arrow 4.

A leaf spring 6 is attached to the front face of each support element 2, and a retaining plate 7 is attached to the rear face thereof, preferably by welding. The spring 6 and retaining plate 7 project above support element 2 and hold between them the wear strip 3, which has a substantially parallelogram-shaped cross-section and a wear surface 9 over which the strainer belt passes. The wear strips 3 each include a bearing surface 10, which is parallel to the wear surface 9, and is also formed as a wear surface and rests on a bearing surface 11 defined by the upper face of the support element 2. The projecting portion of the leaf spring 6 is located in a recess 12 in the front surface 13 of the wear strip 3, which face extends at an acute angle to the wear surface 9. The wear strip 3 is pressed on one side via its bearing surface 10 onto the bearing surface 11 of the support element 2 and simultaneously on the other side via its rear face 14 onto the retaining surface 15 of the projecting portion of the retaining plate 7. The projecting portion of retaining plate 7 is bent in the direction opposite to the direction of movement 4 of the strainer belt 5 to an angle corresponding to the acute angle of the front and rear faces 13 and 14, respectively, of wear strip 3 and the projecting portion may be in the form of a spring.

This makes it possible to hold wear strip 3 in place even if it is constructed so as to have a very small cross section. Furthermore, the wear surface 9 and the bearing surface 10 of wear strip 3 can be used as a wear surface, and only these surfaces need be machined very accurately, normally by grinding. The wear strip 3 can be re-used by removing it from its retained position, turning it over and then inserting it again between the projecting portions of leaf spring 6 and retaining plate 7. Thus, the wear surface 9 is moved to the position of a bearing surface 10 and vice versa. Consequently, in addition to a reduction in manufacturing costs, the wear strip 3 has a longer life since it is possible to utilize two separate surfaces as the wear surfaces. Also advantageous is the fact that the cross bars 2 of the water extraction box 1 can be used as the support elements 2 so that additional adapting elements are not required between the cross bars 2 and wear strips 3.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What I claimed is:

1. A supporting device for a strainer belt in a paper making machine comprising:

a support element including a bearing surface, a wear strip having a wear surface suitable, in use, for facing and supporting the strainer belt, and a bearing surface resting on and being supported by the support element bearing surface, said support element including spring clamp means for clamping said wear strip to said support element bearing surface, said wear strip having a symmetrical shape such that said strip bearing surface is substantially the same as said wear surface so that said strip bearing surface and said wear surface may be disposed interchangeably either to face the support element bearing surface or to face away from the support element bearing surface, said strip bearing surface and said strip wear surface being on opposite sides of said strip, said spring clamp means comprising first and second spring means being attached to the support element, said strip including a front face and a rear face each of which is disposed at an angle to said wear surface, both spring means clampingly engaging the rear and front faces, respectively, whereby an end of the spring means engaging the front face is accommodated in a recess provided in said front face, said rear face being also provided with a recess positioned and shaped such that said rear face recess may accommodate the end of the first named spring means after the strip is inserted such that its bearing surface becomes its wear surface.

2. The supporting device of claim 1 wherein said wear strip has a parallelogram-shaped cross section, and said spring means engaging the front face of said strip is a leaf spring.

3. The supporting device of claim 2 wherein:

said strip includes a front face which extends at an acute angle to said wear surface, and a recess in said front face extending in the longitudinal direction of said strip, said spring means engaging the rear face of said strip including an angled retaining surface, said leaf spring means engaging the front face of said strip pressing said strip via the strip bearing surface against the support element bearing surface and simultaneously pressing the rear face of said strip against said angled retaining surface.

4. The supporting device of claim 2 wherein:

said strip front face extends at an acute angle to said wear surface, said strip rear face extends at an acute angle to said strip bearing surface, and said recess in said front face extends in the longitudinal direction of said strip, said spring means engaging the rear face of said strip includes an angled retaining surface, said leaf spring means engaging the front face of said strip pressing said strip via the strip bearing surface against the support element bearing surface and simultaneously pressing said rear face against said angled retaining surface.

5. The supporting device of claim 4 wherein that part of said support element which forms the retaining surface is a plate, one end of which projects above said support element and is bent forwardly to an angle corresponding to the acute angle of the rear face of said wear strip.

6. The supporting device of claim 1 wherein said strip and support element bearing surfaces extend the longitudinal length of said strip.

7. The supporting device according to claims 1, 2, 3, 4, or 5 wherein the wear surface is less than 10 mm. wide.

8. The supporting device of claim 1 wherein said wear surface has a width of between 4 mm. and 8 mm.

9. The supporting device of claims 1, 2, 3, 4, or 5 characterized in that said wear strip has a height of less than 20 mm.

10. The supporting device of claim 1 wherein said wear strip has a height of between 6 mm. and 15 mm.

11. The supporting device of claims 1, 2, 3, 4, or 5 wherein said wear strip is made substantially of a material which is very hard and has a low friction coefficient relative to the strainer belt with which it is intended to be used.

12. The supporting device of claim 1 wherein said wear strip is made substantially of a ceramic material.

13. The supporting device according to claims 1, 2, 3, 4, or 5 in combination with a water extraction box, characterized in that a plurality of said wear strips are arranged one behind the other in a horizontal plane and in the direction transverse to the longitudinal direction of said strips.

* * * * *